US007918040B2

(12) United States Patent
Lenoir

(10) Patent No.: US 7,918,040 B2
(45) Date of Patent: Apr. 5, 2011

(54) DRIER INSTALLATION FOR DRYING WEB

(75) Inventor: Patrick Lenoir, Villeneuve d'Ascq (FR)

(73) Assignees: NV Bekaert SA, Zwevegem (BE); Bekaert Combustion Technology B.V., Assen (NL)

( * ) Notice: Subject to any disclaimer, the term of this patent is extended or adjusted under 35 U.S.C. 154(b) by 512 days.

(21) Appl. No.: 10/591,431

(22) PCT Filed: Feb. 21, 2005

(86) PCT No.: PCT/EP2005/050731
§ 371 (c)(1),
(2), (4) Date: Nov. 14, 2006

(87) PCT Pub. No.: WO2005/085729
PCT Pub. Date: Sep. 15, 2005

(65) Prior Publication Data

US 2008/0256818 A1 Oct. 23, 2008

(30) Foreign Application Priority Data

Mar. 2, 2004 (FR) ..... 04 02139

(51) Int. Cl.
*F26B 19/00* (2006.01)

(52) U.S. Cl. ..... 34/630; 34/60; 34/80; 34/90; 34/611; 34/619; 34/124; 162/359.1; 280/736; 280/738; 60/39.5; 432/8; 432/59

(58) Field of Classification Search ..... 34/60, 80, 34/90, 117, 124, 611, 619, 630; 162/359.1; 280/736, 738; 60/39.5; 432/8, 59
See application file for complete search history.

(56) References Cited

U.S. PATENT DOCUMENTS 1,387,068 A 8/1921 Olson
(Continued)

FOREIGN PATENT DOCUMENTS

DE 3149003 A1 * 6/1983
(Continued)

OTHER PUBLICATIONS

Patrick Lenoir, US PTO Office Action, U.S. Appl. No. 10/591,393, Aug. 8, 2008, 9 pages.

(Continued)

*Primary Examiner* — Stephen M. Gravini
(74) *Attorney, Agent, or Firm* — Foley & Lardner LLP

(57) ABSTRACT

A drier installation (1) for drying web (2), more particularly paper, which installation is provided for drying a maximum web width, the installation (1) comprises gas-heated radiant elements (3) for radiating the web, arranged according to at least one row (4) stretching out in the transversal (5) direction over the substantially entire maximum web width. The installation (1) comprises at least a transversal convective system (7, 36) equipped with suction and blowing devices (8) for sucking at least part of the combustion products produced by the radiant elements (3) by means of a suction duct (13) and for blowing this pa o the combustion products towards the web (2) by means of a blowing duct (14). Both suction (13) and blowing (14) ducts stretch out in the transversal (5) direction of the web (2). The convective system (7, 36 comprising at least a mixing device (12, 22, 28, 37, 46) installed opposite of the passing web (2) in relation to corresponding suction (13) and blowing (14) ducts and arranged so as to suck and/or blow the combustion products. The drier installation as subject of the present invention is characterized in that the vector average of the projections (V1, V2, V3, V5, V6, V7, V8) in a plane (P1) perpendicular to the web ( ) and stretching out in the transversal (5) direction of the web (2), has component (V4) parallel to the web (2) that is smaller than the maximum web width of the web (2), the vectors representing the respective trajectories of the different jets of sucked and/or blown combustion products.

17 Claims, 6 Drawing Sheets

U.S. PATENT DOCUMENTS

| | | | | | |
|---|---|---|---|---|---|
| 1,405,780 | A | | 2/1922 | Harris | |
| 1,564,565 | A | | 12/1925 | Harris | |
| 1,742,099 | A | | 12/1929 | Robertson et al. | |
| 1,908,643 | A | | 5/1933 | Rice | |
| 1,919,267 | A | | 7/1933 | White | |
| 1,923,729 | A | | 8/1933 | Hull | |
| 1,971,766 | A | * | 8/1934 | Byron et al. | 432/48 |
| 2,095,386 | A | | 10/1937 | Hibberd | |
| 2,099,160 | A | * | 11/1937 | Charch | 34/422 |
| 2,099,162 | A | * | 11/1937 | Eberlin | 34/422 |
| 2,127,956 | A | * | 8/1938 | Helmer | 101/424.1 |
| 2,142,289 | A | | 1/1939 | Sloan | |
| 2,153,325 | A | * | 4/1939 | Cole | 101/416.1 |
| 2,190,046 | A | | 2/1940 | Robinson et al. | |
| 2,302,327 | A | | 11/1942 | Kehoe et al. | |
| 2,308,239 | A | * | 1/1943 | Bell | 34/657 |
| 2,323,936 | A | | 7/1943 | Roberts | |
| 2,395,901 | A | | 3/1946 | Murphree | |
| 2,427,892 | A | * | 9/1947 | Adams | 34/647 |
| 2,432,964 | A | | 12/1947 | Clark | |
| 2,499,141 | A | * | 2/1950 | Helmus | 34/114 |
| 2,545,144 | A | | 3/1951 | Green et al. | |
| 2,639,531 | A | | 5/1953 | Engemann | |
| 2,664,282 | A | * | 12/1953 | Mann | 432/55 |
| 2,664,954 | A | | 1/1954 | Johnson | |
| 2,668,700 | A | * | 2/1954 | Zimmerman | 432/42 |
| 2,707,837 | A | * | 5/1955 | Paulsen et al. | 34/607 |
| 2,720,915 | A | * | 10/1955 | Lenoir | 157/1.17 |
| 2,751,448 | A | | 6/1956 | Timken, Jr. et al. | |
| 2,780,572 | A | | 2/1957 | Carlson | |
| 2,791,039 | A | * | 5/1957 | Rosenbaum | 34/655 |
| 2,833,838 | A | | 5/1958 | Berg | |
| 2,862,305 | A | * | 12/1958 | Dungler | 34/68 |
| 2,920,399 | A | | 1/1960 | Fry, Jr. | |
| 2,975,499 | A | | 3/1961 | Lapp | |
| 3,015,304 | A | | 1/1962 | Carlson et al. | |
| 3,047,473 | A | | 7/1962 | Schmidt | |
| 3,074,776 | A | | 1/1963 | Ryan et al. | |
| 3,076,321 | A | | 2/1963 | Schlichtig | |
| 3,102,537 | A | | 9/1963 | Bartlett, Jr. | |
| 3,123,487 | A | | 3/1964 | Verdier | |
| 3,149,003 | A | * | 9/1964 | Christie et al. | 118/34 |
| 3,166,999 | A | | 1/1965 | Dement | |
| 3,174,228 | A | | 3/1965 | Smith, Jr. | |
| 3,176,411 | A | * | 4/1965 | Jepson et al. | 34/122 |
| 3,188,785 | A | | 6/1965 | Butler | |
| 3,190,790 | A | | 6/1965 | Ploetz et al. | |
| 3,215,558 | A | * | 11/1965 | Dascher | 427/521 |
| 3,231,985 | A | * | 2/1966 | Smith, Jr. | 34/448 |
| 3,235,973 | A | * | 2/1966 | Smith, Jr. | 34/638 |
| 3,237,218 | A | | 3/1966 | Moore | |
| 3,245,062 | A | | 4/1966 | Kornei | |
| 3,246,658 | A | | 4/1966 | Buchholz et al. | |
| 3,252,415 | A | * | 5/1966 | Crawford | 101/181 |
| 3,279,125 | A | | 10/1966 | Leliaert | |
| 3,328,895 | A | * | 7/1967 | Krone et al. | 34/68 |
| 3,343,174 | A | | 9/1967 | Kornei | |
| 3,377,056 | A | * | 4/1968 | Boye | 432/60 |
| 3,378,208 | A | * | 4/1968 | Camenisch | 241/23 |
| 3,390,465 | A | * | 7/1968 | Wise | 34/354 |
| 3,416,237 | A | * | 12/1968 | Sutherland et al. | 34/446 |
| 3,418,723 | A | * | 12/1968 | Burgess et al. | 34/265 |
| 3,446,712 | A | | 5/1969 | Othmer | |
| 3,448,969 | A | * | 6/1969 | Windsor | 432/47 |
| 3,460,818 | A | | 8/1969 | Greaves et al. | |
| 3,502,456 | A | * | 3/1970 | Fetner | 65/32.1 |
| 3,531,946 | A | | 10/1970 | Hart | |
| 3,541,697 | A | * | 11/1970 | Villalobos | 34/115 |
| 3,563,801 | A | | 2/1971 | Cox | |
| 3,570,383 | A | * | 3/1971 | Berg | 396/579 |
| 3,590,495 | A | * | 7/1971 | Tyson et al. | 34/654 |
| 3,643,342 | A | * | 2/1972 | Tyson et al. | 34/555 |
| 3,659,348 | A | * | 5/1972 | Frank | 34/122 |
| 3,676,253 | A | | 7/1972 | Cox | |
| 3,721,016 | A | | 3/1973 | Lee et al. | |
| 3,725,010 | A | | 4/1973 | Penhast | |
| 3,761,237 | A | | 9/1973 | Jeffreys | |
| 3,919,783 | A | * | 11/1975 | Cirrito | 34/450 |
| 4,005,718 | A | * | 2/1977 | Prouse et al. | 131/369 |
| 4,053,279 | A | * | 10/1977 | Eichenlaub | 432/222 |
| 4,116,620 | A | * | 9/1978 | Stibbe | 432/59 |
| 4,146,361 | A | * | 3/1979 | Cirrito | 432/60 |
| 4,175,885 | A | | 11/1979 | Jeppson | |
| 4,259,096 | A | * | 3/1981 | Nakamura et al. | 96/138 |
| 4,290,746 | A | * | 9/1981 | Smith | 431/328 |
| 4,324,613 | A | * | 4/1982 | Wahren | 162/111 |
| 4,326,343 | A | * | 4/1982 | Rathmell | 34/558 |
| 4,326,843 | A | * | 4/1982 | Smith | 431/264 |
| 4,366,824 | A | * | 1/1983 | Rainer et al. | 131/291 |
| 4,373,904 | A | * | 2/1983 | Smith | 431/328 |
| 4,416,618 | A | * | 11/1983 | Smith | 431/328 |
| 4,474,496 | A | * | 10/1984 | Rocheleau | 432/59 |
| 4,498,864 | A | * | 2/1985 | Roth et al. | 432/8 |
| 4,504,220 | A | * | 3/1985 | Sunakawa et al. | 432/72 |
| 4,590,685 | A | * | 5/1986 | Roth | 34/268 |
| 4,622,758 | A | * | 11/1986 | Lehtinen et al. | 34/392 |
| 4,729,548 | A | * | 3/1988 | Sullins | 266/225 |
| 4,783,057 | A | * | 11/1988 | Sullins | 266/44 |
| 4,798,007 | A | * | 1/1989 | Eichenlaub | 34/267 |
| 4,819,444 | A | * | 4/1989 | Meckler | 62/238.6 |
| 4,936,025 | A | * | 6/1990 | Heikkila | 34/420 |
| 4,989,348 | A | * | 2/1991 | Vits | 34/630 |
| 5,069,801 | A | * | 12/1991 | Girovich | 210/770 |
| 5,112,220 | A | * | 5/1992 | Wimberger et al. | 432/8 |
| 5,197,203 | A | * | 3/1993 | Lenoir | 34/90 |
| 5,207,008 | A | * | 5/1993 | Wimberger et al. | 432/8 |
| 5,261,166 | A | * | 11/1993 | Seeley et al. | 34/267 |
| 5,281,261 | A | | 1/1994 | Lin | |
| 5,416,979 | A | * | 5/1995 | Joiner | 34/114 |
| 5,528,839 | A | * | 6/1996 | Seidl | 34/364 |
| 5,531,818 | A | | 7/1996 | Lin et al. | |
| 5,555,635 | A | * | 9/1996 | Seidl | 34/79 |
| 5,737,851 | A | * | 4/1998 | Novak et al. | 34/420 |
| 5,749,164 | A | * | 5/1998 | Bowden | 34/641 |
| 5,771,602 | A | * | 6/1998 | Heikkila et al. | 34/420 |
| 5,830,548 | A | * | 11/1998 | Andersen et al. | 428/36.4 |
| 5,855,476 | A | * | 1/1999 | Gottschalk | 432/59 |
| 5,966,835 | A | * | 10/1999 | Bakalar | 34/267 |
| 6,022,104 | A | | 2/2000 | Lin et al. | |
| 6,024,824 | A | * | 2/2000 | Krech | 156/279 |
| 6,085,437 | A | * | 7/2000 | Stipp | 34/115 |
| 6,088,930 | A | * | 7/2000 | Robin et al. | 34/267 |
| 6,106,659 | A | * | 8/2000 | Spence et al. | 156/345.43 |
| 6,155,029 | A | | 12/2000 | Jain | |
| 6,214,274 | B1 | * | 4/2001 | Melius et al. | 264/280 |
| 6,258,201 | B1 | * | 7/2001 | Krech | 156/279 |
| 6,264,791 | B1 | * | 7/2001 | Sun et al. | 162/168.1 |
| 6,293,788 | B1 | * | 9/2001 | Novak et al. | 432/175 |
| 6,308,436 | B1 | * | 10/2001 | Stipp | 34/422 |
| 6,375,817 | B1 | | 4/2002 | Taylor et al. | |
| 6,393,719 | B1 | * | 5/2002 | Stipp | 34/115 |
| 6,432,267 | B1 | * | 8/2002 | Watson | 162/111 |
| 6,481,118 | B1 | * | 11/2002 | De Vroome | 34/461 |
| 6,553,689 | B2 | * | 4/2003 | Jain et al. | 34/444 |
| 6,560,893 | B1 | * | 5/2003 | Bakalar | 34/110 |
| 6,575,736 | B1 | * | 6/2003 | Aust et al. | 431/328 |
| 6,618,957 | B2 | * | 9/2003 | Novak et al. | 34/264 |
| 6,651,357 | B2 | * | 11/2003 | Bria et al. | 34/427 |
| 6,665,950 | B1 | * | 12/2003 | Riepe et al. | 34/266 |
| 6,681,497 | B2 | * | 1/2004 | Bria et al. | 34/79 |
| 6,694,639 | B2 | * | 2/2004 | Hanaya | 34/115 |
| 6,701,637 | B2 | | 3/2004 | Lindsay et al. | |
| 6,708,496 | B2 | * | 3/2004 | Gadde et al. | 60/773 |
| 6,876,394 | B1 | | 4/2005 | Silverbrook | |
| 6,964,117 | B2 | * | 11/2005 | Parent | 34/528 |
| 7,073,514 | B2 | * | 7/2006 | Barnes et al. | 131/37 |
| 7,176,415 | B2 | * | 2/2007 | Kamitani et al. | 219/400 |
| 7,189,307 | B2 | * | 3/2007 | Goulet et al. | 162/127 |
| 7,205,016 | B2 | | 4/2007 | Garwood | |
| 7,229,529 | B2 | * | 6/2007 | Goulet et al. | 162/127 |
| 7,234,471 | B2 | * | 6/2007 | Fitzgerald et al. | 131/365 |
| 7,276,120 | B2 | * | 10/2007 | Holmes | 118/325 |
| 7,297,231 | B2 | * | 11/2007 | Goulet et al. | 162/168.1 |
| 7,363,929 | B2 | * | 4/2008 | Fagg et al. | 131/35 |
| 7,415,428 | B2 | | 8/2008 | Garwood | |
| 7,481,453 | B2 | * | 1/2009 | Breed | 280/738 |
| 7,523,603 | B2 | * | 4/2009 | Hagen et al. | 60/39.55 |

| | | | | |
|---|---|---|---|---|
| 7,566,381 | B2 * | 7/2009 | Goulet et al. | 162/164.3 |
| 7,575,770 | B2 | 8/2009 | Garwood | |
| 7,632,434 | B2 * | 12/2009 | Duescher | 264/12 |
| 7,648,164 | B2 * | 1/2010 | Breed | 280/736 |
| 7,740,273 | B2 * | 6/2010 | Breed | 280/736 |
| 7,762,580 | B2 * | 7/2010 | Breed | 280/730.2 |
| 2002/0046474 | A1 * | 4/2002 | Novak et al. | 34/259 |
| 2002/0095818 | A1 * | 7/2002 | Jain et al. | 34/448 |
| 2002/0114884 | A1 * | 8/2002 | Friedersdorf et al. | 427/195 |
| 2002/0152630 | A1 | 10/2002 | Lindsay et al. | |
| 2003/0019125 | A1 * | 1/2003 | Hanaya | 34/114 |
| 2003/0135181 | A1 * | 7/2003 | Chen et al. | 604/374 |
| 2003/0152679 | A1 | 8/2003 | Garwood | |
| 2003/0165602 | A1 | 9/2003 | Garwood | |
| 2003/0170357 | A1 | 9/2003 | Garwood | |
| 2003/0170359 | A1 | 9/2003 | Garwood | |
| 2003/0175392 | A1 | 9/2003 | Garwood | |
| 2003/0185937 | A1 | 10/2003 | Garwood | |
| 2003/0185948 | A1 | 10/2003 | Garwood | |
| 2003/0230003 | A1 * | 12/2003 | Miller et al. | 34/444 |
| 2004/0081729 | A1 | 4/2004 | Garwood | |
| 2004/0118009 | A1 * | 6/2004 | Parent | 34/446 |
| 2004/0139623 | A1 * | 7/2004 | Tafel | 34/114 |
| 2004/0146602 | A1 | 7/2004 | Garwood et al. | |
| 2004/0185152 | A1 | 9/2004 | Garwood | |
| 2004/0185154 | A1 | 9/2004 | Garwood | |
| 2004/0185155 | A1 | 9/2004 | Garwood | |
| 2004/0185156 | A1 | 9/2004 | Garwood | |
| 2004/0200341 | A1 | 10/2004 | Walters et al. | |
| 2004/0219079 | A1 * | 11/2004 | Hagen et al. | 422/194 |
| 2004/0226056 | A1 | 11/2004 | Roch et al. | |
| 2004/0231685 | A1 * | 11/2004 | Patel et al. | 131/365 |
| 2004/0235406 | A1 * | 11/2004 | Duescher | 451/527 |
| 2004/0238136 | A1 * | 12/2004 | Patel et al. | 162/139 |
| 2005/0045294 | A1 * | 3/2005 | Goulet et al. | 162/109 |
| 2005/0045295 | A1 * | 3/2005 | Goulet et al. | 162/109 |
| 2005/0056313 | A1 * | 3/2005 | Hagen et al. | 137/3 |
| 2005/0075030 | A1 * | 4/2005 | Coon et al. | 442/327 |
| 2005/0076925 | A1 * | 4/2005 | Fagg et al. | 131/60 |
| 2005/0076929 | A1 * | 4/2005 | Fitzgerald et al. | 131/365 |
| 2005/0118939 | A1 * | 6/2005 | Duescher | 451/527 |
| 2005/0120715 | A1 | 6/2005 | Labrador | |
| 2005/0122350 | A1 | 6/2005 | Silverbrook | |
| 2005/0208188 | A1 | 9/2005 | Garwood | |
| 2006/0014884 | A1 * | 1/2006 | Goulet et al. | 524/500 |
| 2006/0080819 | A1 | 4/2006 | McAllister | |
| 2006/0179680 | A1 * | 8/2006 | Miller et al. | 34/444 |
| 2006/0191160 | A1 * | 8/2006 | Miller et al. | 34/444 |
| 2006/0232052 | A1 * | 10/2006 | Breed | 280/735 |
| 2007/0105980 | A1 | 5/2007 | Yamamoto et al. | |
| 2007/0187056 | A1 * | 8/2007 | Goulet et al. | 162/164.3 |
| 2007/0193060 | A1 * | 8/2007 | Lenoir | 34/273 |
| 2007/0194274 | A1 * | 8/2007 | Goulet et al. | 252/182.12 |
| 2007/0225209 | A1 | 9/2007 | Roch et al. | |
| 2007/0228703 | A1 * | 10/2007 | Breed | 280/735 |
| 2007/0264893 | A1 * | 11/2007 | Mikaelian | 442/59 |
| 2007/0292559 | A1 | 12/2007 | Garwood | |
| 2008/0006381 | A1 * | 1/2008 | Goulet et al. | 162/168.1 |
| 2008/0006382 | A1 * | 1/2008 | Goulet et al. | 162/168.1 |
| 2008/0067792 | A1 * | 3/2008 | Breed | 280/734 |
| 2008/0082237 | A1 * | 4/2008 | Breed | 701/45 |
| 2008/0155985 | A1 | 7/2008 | Labrador | |
| 2008/0243342 | A1 * | 10/2008 | Breed | 701/45 |
| 2008/0256818 | A1 * | 10/2008 | Lenoir | 34/60 |
| 2008/0272580 | A1 * | 11/2008 | Breed | 280/735 |
| 2008/0284145 | A1 * | 11/2008 | Breed | 280/736 |
| 2009/0007453 | A1 * | 1/2009 | Robin et al. | 34/611 |
| 2009/0031581 | A1 * | 2/2009 | Lenoir | 34/611 |
| 2009/0180939 | A1 * | 7/2009 | Hagen et al. | 422/194 |
| 2009/0216910 | A1 * | 8/2009 | Duchesneau | 709/250 |
| 2010/0003904 | A1 * | 1/2010 | Duescher | 451/259 |
| 2010/0012597 | A1 | 1/2010 | David et al. | |

FOREIGN PATENT DOCUMENTS

| | | | | |
|---|---|---|---|---|
| DE | 3148321 | A1 * | 8/1983 | |
| DE | 3336998 | A1 * | 1/1984 | |
| DE | 3545577 | A1 * | 7/1987 | |
| DE | 3738473 | A1 * | 6/1988 | |
| DE | 10028613 | A1 | 12/2001 | |
| EP | 79474 | A1 * | 5/1983 | |
| EP | 145424 | A2 * | 6/1985 | |
| EP | 255318 | A2 * | 2/1988 | |
| EP | 255654 | A1 * | 2/1988 | |
| EP | 275156 | A1 * | 7/1988 | |
| EP | 365502 | A2 * | 4/1990 | |
| EP | 416427 | A1 * | 3/1991 | |
| EP | 0539013 | A1 | 4/1993 | |
| EP | 0489720 | B1 | 7/1997 | |
| EP | 1721108 | A2 * | 11/2006 | |
| EP | 1721109 | A2 * | 11/2006 | |
| FR | 2664282 | A1 * | 1/1992 | |
| FR | 2 771 161 | A1 | 5/1999 | |
| FR | 2791039 | A1 * | 9/2000 | |
| GB | 2142328 | A * | 1/1985 | |
| GB | 2190968 | A * | 12/1987 | |
| GB | 2308239 | A * | 6/1997 | |
| GB | 2427892 | A * | 1/2007 | |
| JP | 05132888 | A * | 5/1993 | |
| JP | 11-173757 | A | 7/1999 | |
| WO | WO 8906706 | A1 * | 7/1989 | |
| WO | WO 8910449 | A1 * | 11/1989 | |
| WO | WO 03/036209 | A1 | 5/2003 | |
| WO | WO 2005085729 | A2 * | 9/2005 | |

OTHER PUBLICATIONS

Patrick Lenoir, US PTO Office Action, U.S. Appl. No. 10/591,393, Jan. 15, 2009, 9 pages.

Patrick Lenoir, US PTO Office Action, U.S. Appl. No. 10/591,393, May 28, 2009, 9 pages.

Patrick Lenoir, USPTO Office Action, U.S. Appl. No. 10/591,393, Jul. 8, 2010, 12 pages.

Patrick Lenoir, USPTO Office Action, U.S. Appl. No. 10/591,393, Oct. 26, 2009, 11 pages.

* cited by examiner

DRIER INSTALLATION FOR DRYING WEB

FIELD OF THE INVENTION

The present invention concerns a drier installation for a passing web, more particularly paper.

BACKGROUND OF THE INVENTION

There exists e.g. according to FR-A-2771161 in the name of the applicant an installation on the one hand consisting of at least the web, the gas-heated radiant elements arranged according to at least one row stretching out in the transversal direction of the web, substantially over its entire width, and, downstream at least one row of radiant elements, at least a transversal convective system equipped with suction and blowing devices to suck at least part of the combustion products produced by the radiant elements and to blow the said part of the combustion products towards the web. In a traditional way, the installation generally also has devices to extract the warm gases resulting from the convective exchanges between the passing web and the said combustion products.

In a traditional way, the suction and blowing devices have a mixing device, such as e.g. a ventilator, that is, for several known reasons, shifted laterally at the outside of the web, in relation to the median longitudinal axis usually at a large, even extremely large, distance in relation to the width of the web.

In that way, the ventilator has to laterally collect the combustion products that are initially divided over the entire width of the web, mix the combustion products and divide them again over the entire width of the web.

Such a mixing entails an important consumption of energy.

In addition, such an installation has suction and blowing ducts that, at least in the transversal direction of the web, have an important size.

These ducts dissipate thermal energy by radiation and convection. There is amongst other things aspiration of cold air that is cooled down in the combustion products.

Because of these different reasons, the temperature of the combustion products blown on the web is considerably lower than the temperature of the combustion products generated by the radiant elements.

Such an installation thus implicates a considerable consumption of mechanical energy and also a considerable loss of thermal energy, thus resulting in considerable investment and operating costs, and also occupies a large surface.

SUMMARY OF THE INVENTION

The objective of the present invention is to remedy the inconveniences of the known installations and to propose a drier installation implicating a reduced consumption of mechanical energy and a reduced loss of thermal energy, lower investment and operation costs, and necessitating less surface.

According to the present invention, the drier installation of the aforementioned type is characterized by the fact that the suction and blowing devices of the convective system have at least one suction and blowing device installed opposite of the passing web in relation to corresponding suction and blowing ducts that at least stretch out in the transversal direction of the web, and arranged so as to suck and/or blow the said combustion products in such a way that the vector average of the projections, in a perpendicular plane to the web that stretches out in the transversal direction of the web, of the vectors representing the respective trajectories of the different jets of the sucked and/or blown combustion products have a component parallel to the web that is smaller than approximately the maximum web width of the web, and preferentially to nearly half of the maximum web width of the web.

The term "maximum web width" is to be understood as the maximum dimension of the web in direction perpendicular to the throughput direction of the web, which can be dried by this drier installation.

In general and more particularly in the case of one ventilator, the projection in a plane perpendicular to the web and stretching out in the transversal direction of the said web, of a vector representing the trajectory of a jet of combustion product, can be analysed in a first vector substantially parallel to the web and stretching out to the median longitudinal plane of the web, and in a second vector stretching out from the median longitudinal plane of the web to the starting or end point on the web of the said jet of combustion products.

In this case, the vector average of the projections in the said transversal plane consists of a first resultant parallel to the web and corresponding to the vector average of the first aforementioned vectors, and a second resultant corresponding to the vector average of the second aforementioned vectors and substantially perpendicular to the web.

The present invention therefore aims at minimizing this first resultant and to considerably reduce the trajectories of the jets of combustion products and the mechanical mixing energy needed to suck and blow the different jets of combustion products.

In addition, these shorter trajectories of combustion products require shorter suction and blowing ducts and smaller dimensions corresponding to smaller surfaces that lead to considerably smaller losses of thermal energy by radiation and convection.

Likewise, the temperature difference between the sucked combustion products and the blown combustion products is substantially reduced.

In that way, the thermal transfers between the combustion products and the passing plane can be maximized, and it is also possible to obtain an extremely compact drier installation in which the combustion products are blown at the highest possible temperature.

It is understood that, conversely, for a given thermal transfer between the combustion products and the web, the blown flow can be weaker proportional to the blowing temperature increase.

In a drier installation according to the present invention with a suction trajectory of the warm combustion products and a blowing trajectory of the warm combustion products, this drier installation will have an energy efficiency and compactness that will improve proportionately to the shorter distance of the trajectories and the limitation of the thermal losses.

In an installation according to the present invention, combining gas-heated radiant elements and convective thermal exchange devices, such a compactness is obtained by placing the mixing devices of warm fluids as close as possible to the source producing the high-temperature combustion products, namely as close as possible to the gas-heated radiant elements.

In such an installation, by minimizing the dilution of the combustion products released directly by the gas-heated radiant elements, the volumes of the mixed fluid can be considerably reduced in order to maintain a high energy level allowing to obtain a maximal convective thermal transfer with the passing web.

In this configuration, the mixed volumes are of the same order (1 to 3 times the volume) as the volumes of the combustion products released by the gas-heated radiant elements, and are considerably lower than the ones that are usually mixed in the drier installations in which the mixing device is shifted laterally in relation to the web, which can represent 5 to 20 times the volume of the combustion products.

Finally, after the convective thermal exchanges with the passing web, the warm gases that have to be extracted from the drier installation in a centralized and laterally shifted way, have a low temperature and therefore, smaller volumes allow the use of extraction circuits of reduced size.

According to a first version of the invention, each mixing device is arranged in such a way that the vector average of the projections, in a perpendicular plane to the web and stretching out in the transversal direction of the web, of the vectors representing the respective trajectories of the different jets of sucked and/or blown combustion products is substantially perpendicular to the web or substantially null.

This realization mode practically comes to annulling the first aforementioned resultant parallel to the web.

According to another version of the invention, each mixing device and the corresponding blowing ducts are arranged so that the vectors representing the respective trajectories of the different jets of blown combustion products have, in projection to a plane perpendicular to the web and stretching out according to the median longitudinal axis of the web, a component that is not null.

This allows to create a zone of convective thermal exchanges between the combustion products and the web stretching out over a preset distance in the direction in which the web is passing by.

According to another version of the invention, each mixing device and the corresponding suction and blowing ducts are arranged so that the vectors representing the respective trajectories of the different jets of sucked and/or blown combustion products are distributed in a highly symmetrical way in relation to the said perpendicular plane to the web and stretch out according to the median longitudinal axis of the web.

Other characteristics and advantages of the present invention will appear from the detailed description below.

BRIEF DESCRIPTION OF THE DRAWINGS

The attached drawings only have an exemplary non-limitative function.

DESCRIPTION OF THE PREFERRED EMBODIMENTS OF THE INVENTION

Figure 2:
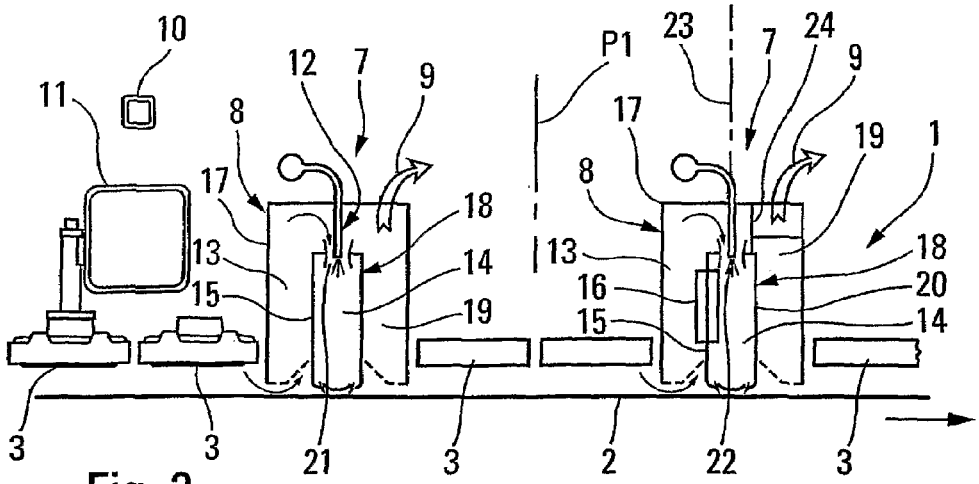
FIG. 2 is a cross-sectional schematic view according to II-II in FIG. 1.
Figure 1:
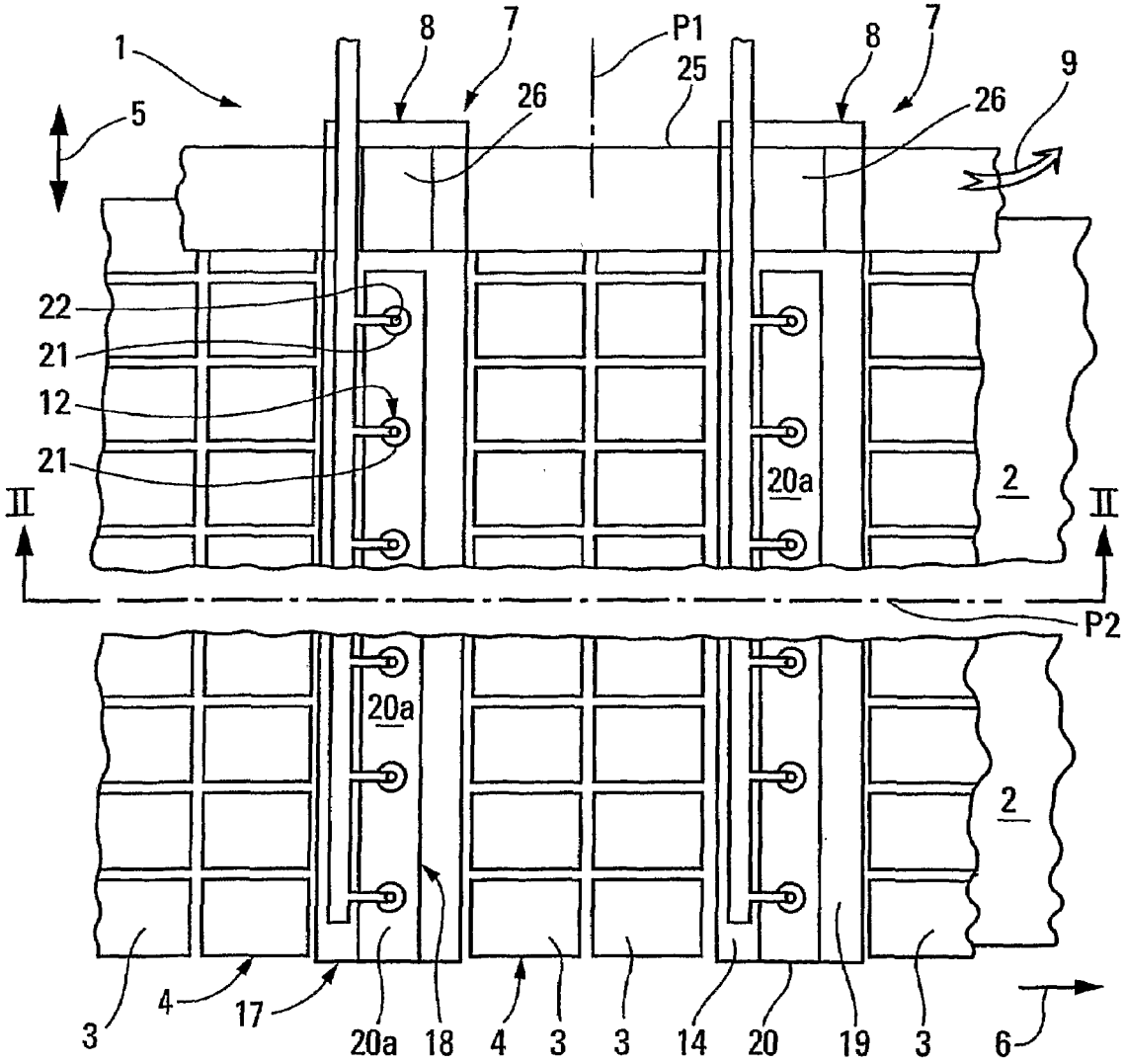
FIG. 1 is a schematic view from above of a drier installation according to a first realisation mode of the present invention.
Figure 9:
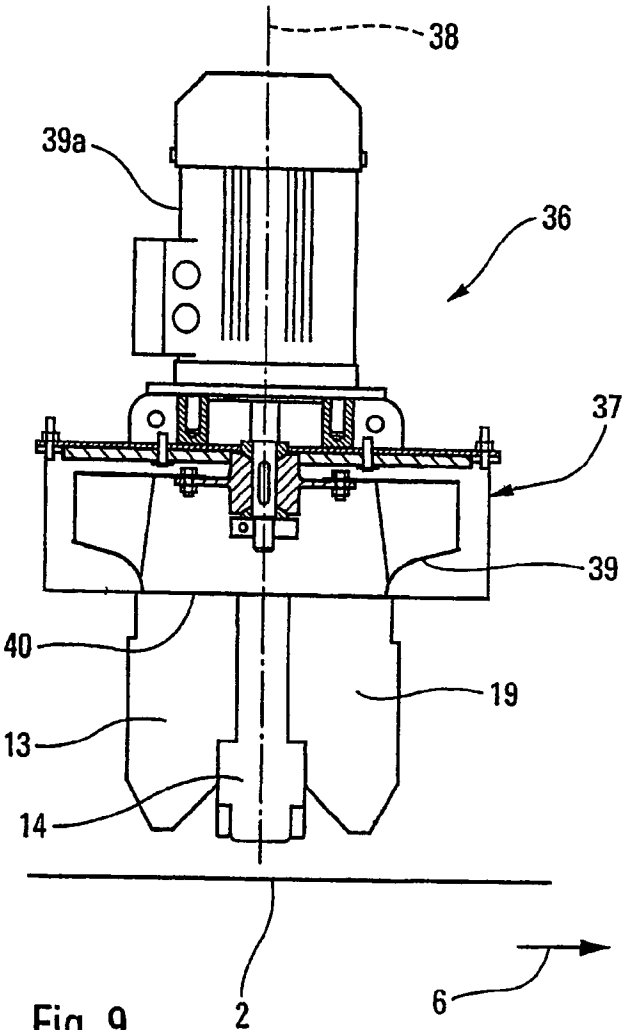
FIG. 9 is an enlarged view of a detail of FIG. 7.

FIGS. 1 and 2 represent a drier installation 1 for a passing web 2, more particularly paper, e.g. for a web of coated paper that has been treated in a humid way and has to be dried without contact.

The installation 1 comprises, on the one hand, of at least the web 2, the gas-heated radiant elements 3, arranged according to at least one row 4 stretching out in the transversal direction, schematised by the arrow 5, of the web 2 substantially over the entire maximum web width of the web 2.

The installation 1 also comprises, downstream of at least one row 4 of radiant elements 3, referring to the direction of the passing of the web, schematised by the arrow 6, that also represents the longitudinal direction of the said web 2, at least one convective transversal system 7 including suction and blowing devices, schematised in 8, to suck at least a part of the combustion products generated by the radiant elements 3 and to blow the said part of the combustion products towards the web 2, as well as devices, schematised by the arrow 9, to extract the warm gases resulting from the convective thermal exchanges between the passing web 2 and the said combustion products.

The radiant elements 3 can be gas-heated radiant elements of whatever type, arranged in any possible way in relation to one another and in relation to gas supply tubes, schematised as 10, and to combustion air supply tubes, schematised as 11, which are respectively arranged in any possible way.

More particularly, the radiant elements 3 and the gas and air tubes 10 and 11 can be arranged as described in applications for patents deposited at the same day as the present application, in the name of the applicant, and describing more particularly radiant elements adapted to be removed from the installation towards the front, in the direction of the web 2, and arranged so as to generate combustion products at a temperature that is as high as possible.

According to the present invention, the suction and blowing devices 8 include at least one mixing device 12 installed opposite of the passing web 2 in relation to corresponding suction 13 and blowing 14 ducts that stretch out at least in the transversal direction 5 of the web 2. This mixing device 12 is arranged so as to suck and/or blow the combustion products so that the vector average of the projections, in a plane P1 perpendicular to the web 2 and stretching out in the transversal direction 5 of the web, of the vectors representing the respective trajectories of the different jets of sucked and/or blown combustion products has a component parallel to the web 2 that is smaller than approximately the maximum web width of the web 2, and preferentially smaller than half of approximately the maximum web width of the web 2.

This component parallel to the web 2 can be substantially null. In that event, the vector average of the said projections is substantially perpendicular to the web or substantially null (see below).

In that way, the trajectories of the combustion products are kept as short as possible and the high energy potential of these combustion products is maintained maximally.

In the example represented in FIGS. 1 and 2, the transversal convective system 7 includes at least one suction duct 13 that stretches out at least in the transversal direction 5 of the web 2, and at least one blowing duct 14 that stretches out at least in the transversal 5 direction of the web 2. The suction duct 13 and the blowing duct 14 are separated from one another by a common wall 15 equipped, if the occasion arises, with the means, schematised as 16, advancing the thermal exchanges between the sucked combustion products and the blown production products.

Such devices, known as such, are e.g. of the type described in the French patent application FR-A 2 790 072 in the name of the applicant.

In the realization mode of the FIGS. 1 and 2, the transversal convective system 7 has a first exterior casing 17 that has, in a longitudinal cross-section, i.e. in a plane P2 perpendicular to the web and stretching out according to the median longitudinal axis 54 of the web 2, a substantially U-shaped cross-section, opening towards the web 2, that substantially stretches out in the transversal direction 5 of the web 2.

The convective system 7 includes amongst other things, inside the first external casing 17, a second internal casing 18 that also has a substantially U-shaped longitudinal cross-section, opening towards the web 2, and stretching out inside the first external casing 17 to guide the blown combustion products towards the web 2 and to insulate these blown combustion products, on the one hand, in relation to the sucked combustion products, and on the other hand, in relation to the warm gases resulting from the convective thermal exchanges with the web 2.

In that way, the suction duct 13 consists of the upstream part of the volume comprised between the first external casing 17 and the second internal casing 18. The second internal casing 18 in that way substantially delimitates the blowing duct 14. Finally, the lower part of the volume comprised between the second internal casing 18 and the first external casing 17 constitutes a suction duct 19 that is part of the devices 9 to extract the warm gases, that are traditional known devices that do not have to be described in detail here.

In the example of FIGS. 1 and 2, the wall 20 of the second internal casing 18 has several first openings 21 made at a distance of the web 2, and an organ 22 to blow air under pressure towards the web 2 is arranged substantially in the axis 23 of each first opening 21 so as to create, in a known way that does not have to be described further in detail, a venturi effect, so as to suck at least a part of the combustion products through the suction duct 13 and to blow them towards the web 2 through the blowing duct 14.

In the represented example, the axis 23 is oriented in the direction perpendicular to the web 2.

This axis can also be given other directions inclined in any possible direction in relation to this perpendicular, without leaving the scope of the present invention (see below).

The internal arrangement of the first external casing 17 can be realized in any known way. It is e.g. possible to foresee, optionally, a transversal wall, schematised as 24 in the right-hand part of FIG. 2, to physically separate the extraction duct 19 containing the extracted warm gases from the suction duct 13 containing the sucked combustion products.

Such a transversal wall is not strictly necessary.

FIG. 1 schematises, as an example of devices 9 to extract the warm gases, after the convective thermal exchanges with the web 2, an extraction casing, schematised as 25, communicating through an opening 26 with each of the suction ducts 19. The extraction casing 25 is, in a known way, connected to a known extraction device, such as e.g. a ventilator, not represented.

Figure 3:
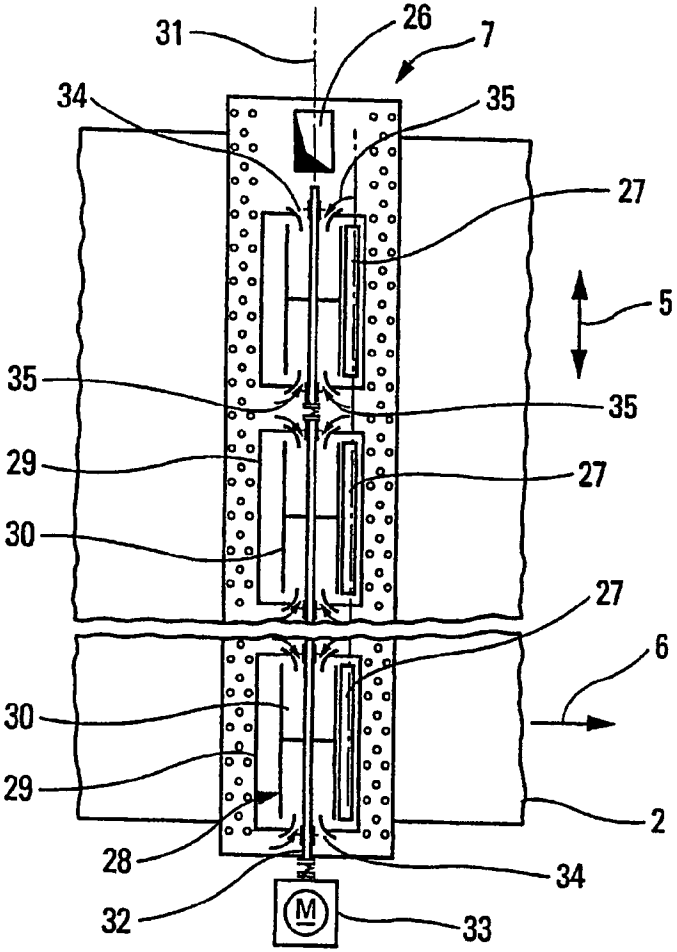
FIG. 3 is a partial view similar to FIG. 1, schematically representing another realization mode of the present invention.
Figure 4:
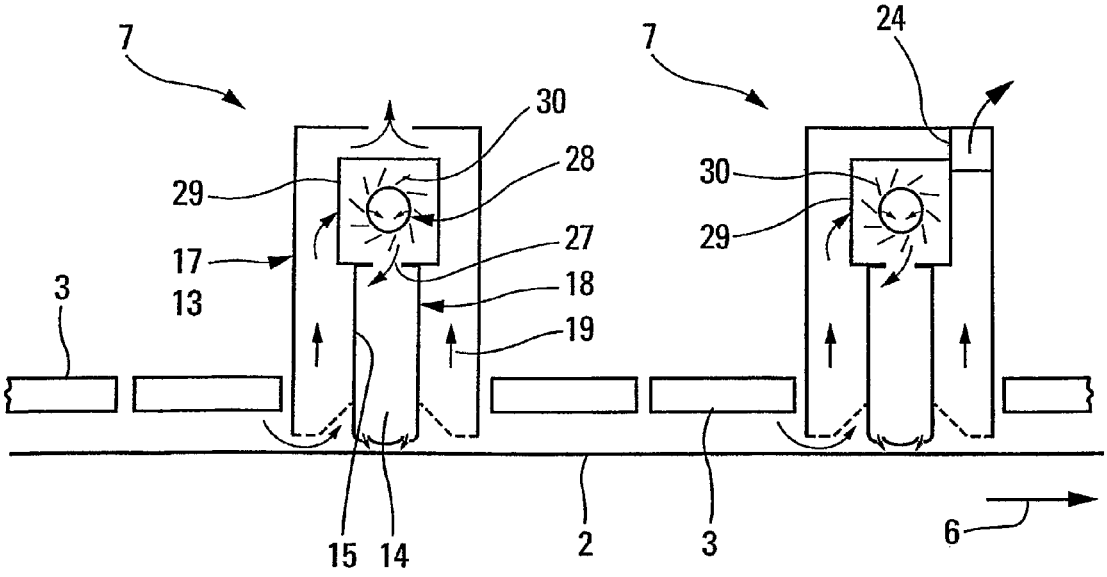
FIG. 4 is a cross-sectional schematic view according to IV-IV in FIG. 3.
Figure 5:
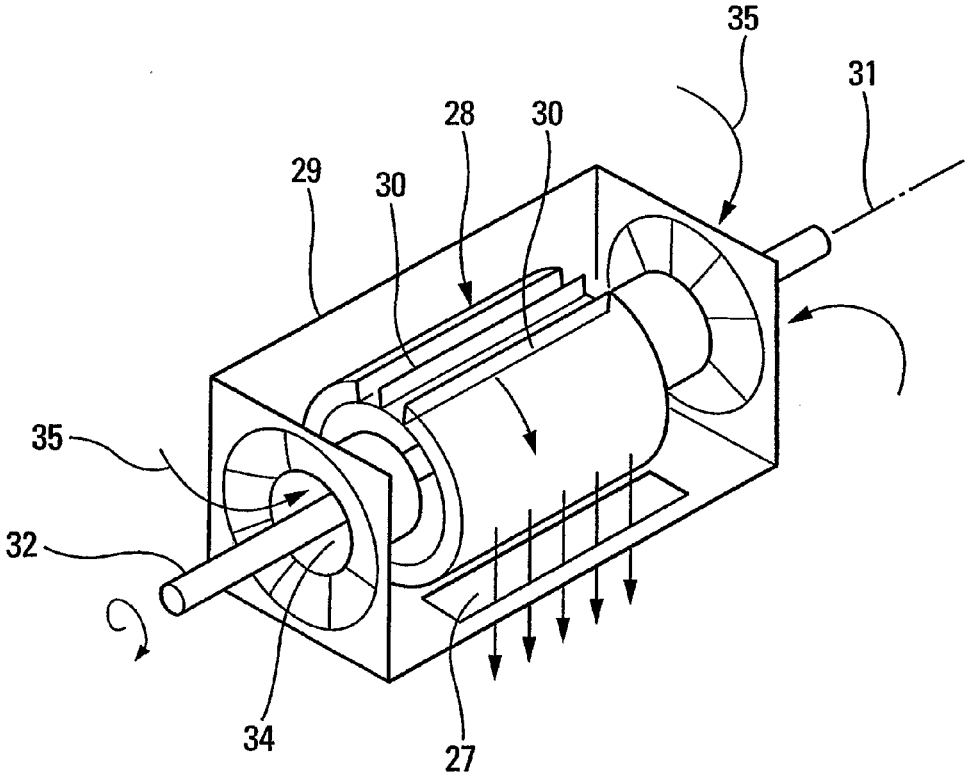
FIG. 5 is an enlarged view in perspective of the mixing device schematised in FIGS. 3 and 4.

In the schematised realisation mode in the FIGS. 3 to 5, the transversal convective system 7 includes, as the realization mode of FIGS. 1 and 2, a first external casing 17 and a second internal casing 18 described above.

The wall 20 of the second internal casing 18 has several second openings 27 made at a distance of the web 2 and stretching out in the transversal 5 direction of the web 2.

A cylindrical rotor 28 is installed at the interior side of the first external casing 17 in front of each of the second openings 27.

Each cylindrical rotor 28 is installed inside a corresponding enclosed space 29 and has radial blades 30. Each cylindrical rotor 28 turns around a respective axis 31 parallel to the web 2 and substantially perpendicular to the passing direction 6 of the web 2.

In the represented example, the different rotors 28 are installed on the same pole 32 driven by an engine 33.

The combustion products are sucked and penetrate inside each enclosed space 29 through axial openings 34 (see FIG. 5), as schematised by the arrows 35, and are blown through the second openings 27 in the blowing duct 14.

In the convective system represented in the left-hand part of FIG. 4, the extraction 26 opening of the warm gases is in communication with the suction duct 13 and with the extraction duct 19.

In the convective system represented in the right-hand part of FIG. 4, a transversal wall 24 separates the suction duct 13 from the extraction duct 19.

It should be remarked that in both realization modes described above, the first openings 21 and the second openings 27 are made in the tube 20*a*, substantially parallel to the passing web 2 of the wall 20 of the second internal casing 18.

In the realization mode of FIGS. 6 to 9, each convective system 36 at least has one turbine 37 of which the axis 38 is substantially perpendicular to the web 2.

In the represented example, each turbine 37 has a centrifugal turbine wheel 39 of which the suction opening 40 is connected to an upstream transversal suction duct 13 in relation to the web 2. The wheel 39 is driven by an engine 39*a*.

The sucked combustion products in the duct 13 are blown through two tangential outlet openings 41 substantially directly opposite to the transversal direction 5 of the web 2, and connected to a transversal blowing duct 14 adjacent to the suction duct 13.

In order not to reduce the clearness of the drawings, the respective connections between on the one hand the suction opening 40 of the centrifugal wheel 39 and the suction duct 13, and on the other hand between the tangential outlet openings 41 and the blowing duct 14, are not represented, as these connections are known as such and therefore do not need to be described and represented in detail.

Figure 6:
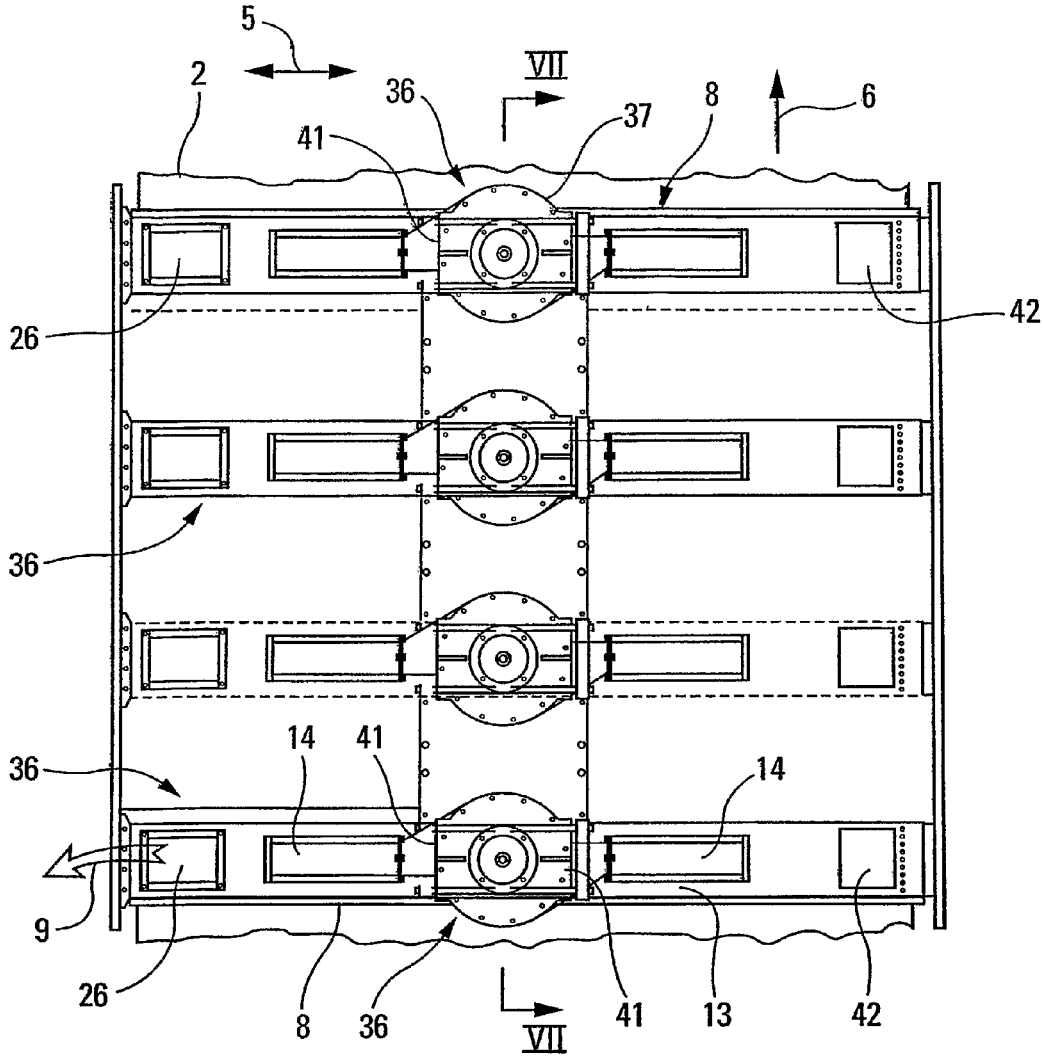
FIG. 6 is a similar view to FIG. 1 representing another realization mode of the present invention.

In the example represented in FIG. 6, each transversal convective system 36 has, along a lateral edge of the web 2, in this instance in the right-hand side of the figure, a fresh air inlet opening, schematised as 42, advantageously closed off by a valve, that is not represented, to allow the entrance of ambient temperature air inside the suction duct 13 in order to dilute the combustion products and thus limit the temperature of the combustion products sucked by turbine 37, if necessary.

In addition, each convective system 36 also has, for instance at the side of the web 2 opposite of the openings 42, an extraction opening 26 of the warm gases obtained after the convective thermal exchanges between the blown combustion products on the web 2 through the blowing duct 14, on the one hand, and the said web 2 to be dried, on the other hand.

As described above, each opening 26 is advantageously connected, e.g. by an extraction casing, that is not represented, to an extraction device, such as a ventilator, in a way known as such.

In the realization mode schematised in FIG. 10, a mixing device 46, known as such, and a corresponding blowing duct 14 are so arranged that the vectors representing the respective trajectories of the different jets of blown combustion products have in projection on the plane P2, the plane of FIG. 10, perpendicular to the web 2 and stretching out according to the median longitudinal axis 54 of the web 2, a component that is not null (see below).

In the represented example, the represented mixing device 46 is an organ 22 adapted to blow air under pressure through a first opening 21 thus forming a venturi, as described above.

The suction duct 13 is substantially perpendicular to the web 2 while the blowing duct 14 is inclined towards the lower reaches and towards the web 2 to blow the sucked combustion products in the same inclined direction.

Figure 10:
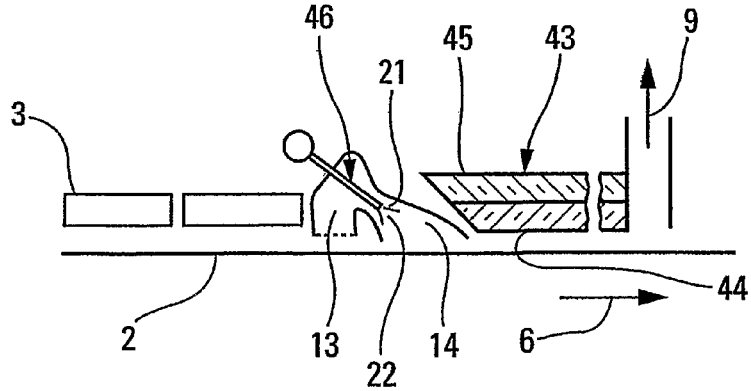
FIG. 10 is a partial cross-sectional schematic view similar to FIG. 2 of another realization method of the present invention.
Figure 7:
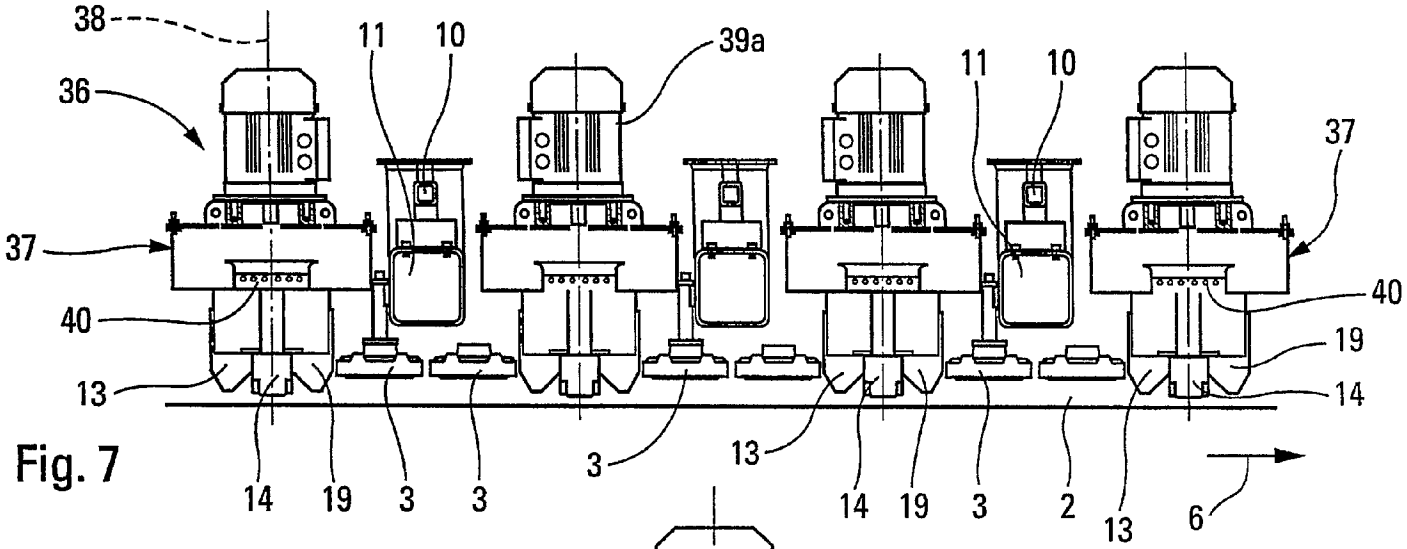
FIG. 7 is a cross-sectional schematic view according to VII-VII in FIG. 6.
Figure 8:
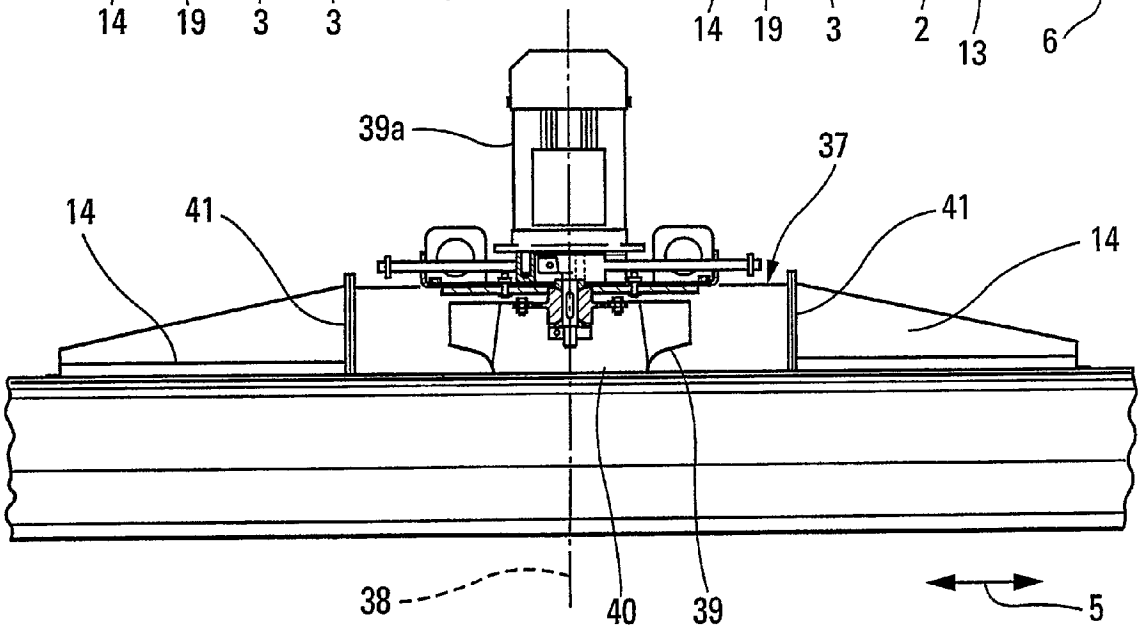
FIG. 8 is a cross-sectional schematic view according to VIII-VIII in FIG. 6.

In order to further improve the thermal exchanges between the web 2 to be dried and the blown combustion products, the realization mode of FIG. 10 has an arc 43 adapted so as to allow the separation of the warm gases in order to keep them in contact with the web.

The arc 43 is e.g. made of a first layer 44 that is in contact with the warm gases and realized in a material that can endure the temperature of these warm gases, such as e.g. in a material that has refractory properties, and by a second layer 44 in a material having e.g. insulating thermal properties.

Figure 11:
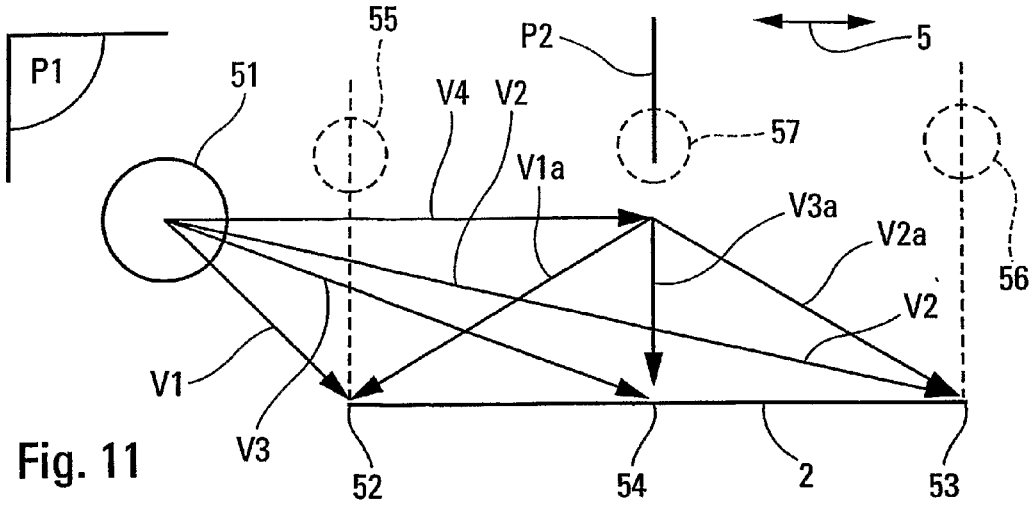
FIGS. 11, 12 and 13 are schemes representing respectively the projections, in a plane perpendicular to the web and stretching out in the transversal direction of the web, of the vectors representing the respective trajectories of the different jets of sucked and/or blown combustion products, respectively according to a general realization mode of the present invention, according to the realization mode of the FIGS. 6 to 9.
Figure 12:
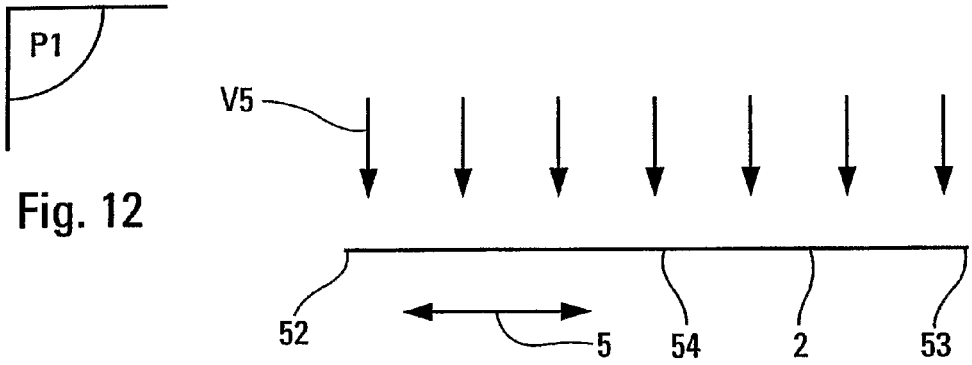
Figure 13:
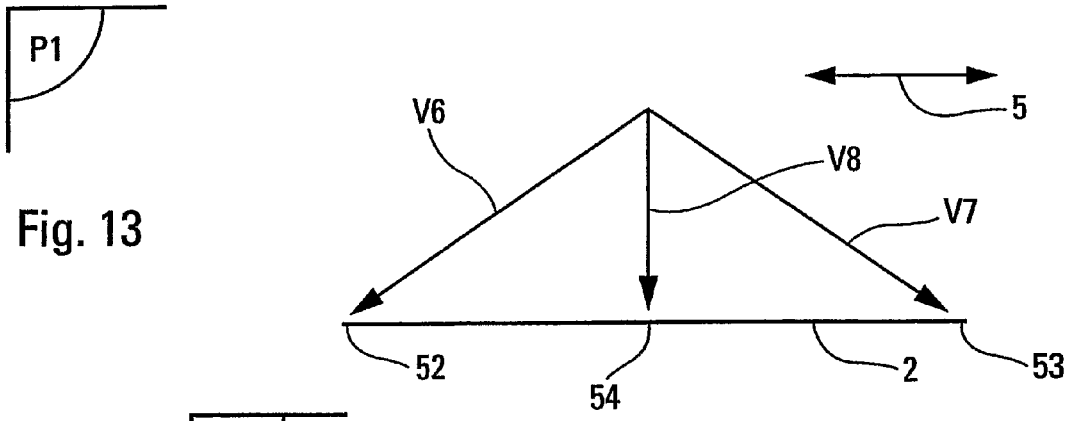

FIGS. 11 to 13 schematically represent the projections, in a plane P1 perpendicular to the web 2 and stretching out in the transversal 5 direction of the web 2, of the vectors representing the respective trajectories of the different jets of sucked and/or blown combustion products, respectively of the different realization modes of the present invention. For the clearness of these figures, only the vectors corresponding to the blown jets have been represented.

FIG. 11 represents a general realization mode of the present invention equipped with a suction and blowing ventilator 51 that is slightly shifted laterally in relation to the passing web 2.

The vector V1 represents the jet directed towards the lateral edge 52 of the web, which edge is closest to the ventilator 51, the left-hand edge at the figure.

The vector V2 represents the jet directed towards the lateral edge 53 that is furthest away from the web 2.

The vector V3 represents the jet that reaches the median longitudinal axis 54 of the web 2.

Each of the vectors V1, V2 or V3 can be disintegrated in a vector V4, substantially parallel to the web and stretching out to the plane P2 perpendicular to the web and stretching out according to the median longitudinal axis 54 of the web, and a corresponding second vector V1*a*, V2*a*, V3*a* that reaches the corresponding impact point on the web 2. The vectors V1*a* and V2*a* are substantially symmetrical in relation to the plane P2, so that their vector average is parallel to V3*a* and comprised within plane P2.

The length of the vector V4 represents the average trajectory, parallel to the web, of the projections of the different jets of combustion products.

In a more precise way, the vector V4 represents the parallel component to the web 2 of the vector average of the projections V1, V2, V3 in the plane P1 perpendicular to the web 2 and stretching out in the transversal 5 direction of the web 2, of the vectors representing the respective trajectories of the different jets of sucked and/or blown combustion products.

It is repeated here, if necessary, that the vector average of the vectors V1, V2, V3 (or of n vectors) equals the vector sum of these vectors divided by the number of vectors.

The length of the component V4 equals in the represented example the average trajectory in the direction 5 and is smaller than the width of the web 2, the origin of each vector V1 to V4 being the axis of the ventilator if the mixing device is a ventilator, regardless of the orientation of the said axis that, in this instance, is parallel to the passing direction 6 of the web 2.

It is understood that for a ventilator situated in the position schematised as 55 in FIG. 11, plumb to the lateral edge 52 of the web, or in the position, schematised as 56, plumb to the lateral edge 53 of the web, the length of V4 parallel to the web will be equal to half the width of the web 2, and will be equal to the average trajectory in direction 5.

Likewise, for a ventilator in the position schematised as 57, plumb to the median longitudinal axis 54 of the web 2, the average trajectory would be equal to a quarter of the width of the web 2, whereas the vector average V4 is null.

For a position of the ventilator between the axial position 57 and one of the aforementioned positions 55 or 56, the vector component V4 will have a length that is smaller than the average trajectory parallel to the web as the parallel components to the web 2 of the vectors connecting the ventilator axis respectively to the lateral edges 52, 53 of the web 2 will have opposite directions.

The vector average of the vectors V1*a*, V2*a*, V3*a* is substantially perpendicular to the web 2. The average trajectory parallel to the web of the vectors V1*a*, V2*a* and V3*a* is nearly a quarter of the width of the web.

FIG. 12 schematises the projections in the plane P1 of the vectors representing the respective trajectories of the different jets of sucked and/or blown combustion products corresponding to the realization modes represented respectively in FIGS. 1 and 2, on the one hand and 3 to 5 on the other hand.

These projections are mainly perpendicular to the web 2.

FIG. 13 represents the projections in the plane P1 of the vectors representing the respective trajectories of the different jets of sucked and/or blown combustion products corresponding to the realization mode of FIGS. 6 to 9.

The axis 38 of the turbine 37 is in the plane P2 that comprises the median longitudinal axis 54 of the web 2.

The vectors V6, V7 and V8 start at the turbine 37 stretching out respectively to the lateral edge 52, to the lateral edge 53 of the web 2 and to the median longitudinal axis 54.

The vector average of these vectors is substantially perpendicular to the web, as already indicated above for the vectors V1*a*, V2*a* and V3*a*.

The average component of the different vectors V6, V7, V8 parallel to the web 2 corresponds substantially to one quarter of the width of the web.

Figure 14:
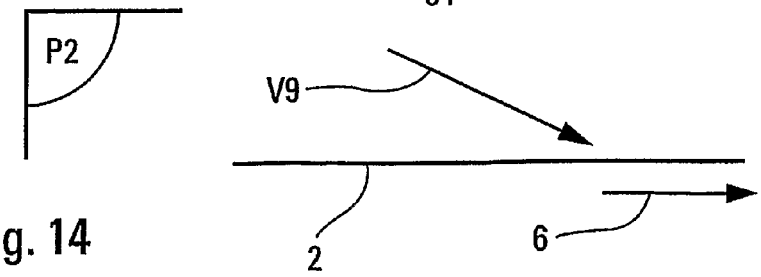
FIG. 14 is a scheme representing the projections, in a plane perpendicular to the web and stretching out according to the median longitudinal axis of the web, of the vectors representing the respective trajectories of the different jets of the combustion products blown in the event of the realization mode in FIG. 10.

FIG. 14 schematises the projections in the plane P2 perpendicular to the web 2 and comprising the median longitudinal axis 54 of the web 2 of the vectors representing the jets of combustion gas blown towards the web in the event of the realization mode schematised in FIG. 10. The sucked gases can have any possible direction.

These projections all comprise the vector V9, stretching out in the passing direction 6 of the web and in the direction of the said web 2, and thus inclined towards the lower reaches in relation to the web.

Therefore, they have, in this plane P2, a component that is not null; contrary to the cases described above of the realization modes of the FIGS. 1 to 9 and 11 to 13.

If the vector V9 would be substantially parallel to the web 2, the projection in the plane P1 of the vectors representing the trajectories of the different jets would be substantially null.

Obviously, the present invention is not limited to the realization modes described above, and many changes and modifications can be made to these realization modes without leaving the scope of the present invention.

One can of course use any mixing device adapted to suck and blow the combustion products, and arrange these mixing devices and the corresponding suction and blowing ducts in any known way.

The afore-described mixing devices can also be arranged in a different way than the ways described above.

These mixing devices and the corresponding transversal convective systems can be linked to gas-heated radiant elements of any type, and these radiant elements can be arranged in any possible way.

One can, as schematised in FIGS. 1, 2, 3, 4, 6 and 7, foresee at least two transversal convective systems according to the present invention, arranged one after the other in the passing direction 6 of the web 2 and separated from one another by at least one transversal row 4 of gas-heated radiant elements.

One can also foresee a suction duct or a convective transversal system upstream the first row of radiant elements encountered by the web 2.

Obviously, the devices of the invention described above, the suction duct 13 and the blowing duct 14, the mixing devices 12, 22, 28, 37, the several walls 15, 20, etc. are designed and arranged in a known way so that they can endure durably and reliably the high temperatures of the sucked and/or blown combustion products.

Obviously, it is also possible to foresee in addition in a traditional way thermal insulation devices and/or traditional cooling-down devices known to protect certain specific devices, such as e.g. an electrical engine.

We have thus described and represented a drier installation designed and arranged to reduce the trajectories of the sucked and/or blown combustion products, to limit as much as possible thermal losses in order to maintain the high energy potential of these combustion products and thus allow an excellent return of the convective thermal exchanges between the web and the sucked and blown combustion products.

In addition to the important improvement of the thermal exchanges between the combustion products and the web, the mechanical energy needed to suck and blow these combustion products is also considerably reduced.

The invention claimed is:

1. A drier installation for drying a web, said installation being provided for drying a maximum web width, said installation comprising:

radiant elements configured to radiate said web arranged in at least one row stretching out in a transverse direction to a substantially entire maximum web width, wherein the radiant elements produce combustion products, and at least a transversal convective system equipped with suction and blowing devices configured to suck at least part of the combustion products produced by said radiant elements by a suction duct and configured to blow said part of the combustion products towards said web by a blowing duct, wherein said suction and blowing ducts stretch out in the transverse direction of said web, said convective system comprising at least a mixing device installed opposite of the web in relation to corresponding suction and blowing ducts, wherein the mixing device is arranged so as to suck and/or blow said at least part of the combustion products, said sucked and/or blown at least part of the combustion products comprising different jets, wherein respective trajectories of the different jets are represented by vectors, each of said vectors having a projection in a plane perpendicular to said web and stretching out in the transverse direction of said web, wherein a vector average of the projections of the vectors in the plane perpendicular to said web and stretching out in the transverse direction of said web has a component parallel to the web that is smaller than said maximum web width of said web.

2. The drier installation according to claim 1, wherein said component parallel to the web is smaller than approximately half of said maximum web width of the web.

3. The drier installation according to claim 1, wherein each mixing device is arranged in such a way that the vector average, wherein the vector average is an average of vectors representing the respective trajectories of the different jets of the sucked and/or blown combustion products by each of said mixing devices, of the projections of the vectors in the plane perpendicular to the web and stretching out in the transverse direction of said web is substantially perpendicular to said web or substantially null.

4. The drier installation according to claim 1, wherein each mixing device and the corresponding blowing duct are arranged so that the vectors representing the respective trajectories of the different jets of combustion products blown on said web have, in projection to the plane perpendicular to the web and stretching out according to a median longitudinal axis of said web, a component that is not null.

5. The drier installation according to claim 1, wherein each mixing device and the corresponding suction and blowing ducts are arranged so that the vectors representing the respective trajectories of the different jets of sucked and/or blown combustion products are distributed in a substantially symmetrical way in relation to the plane perpendicular to said web and stretching out according to a median longitudinal axis of said web.

6. The drier installation according to claim 1, wherein said convective system includes at least one suction duct that stretches out at least in the transverse direction of the web, and at least one blowing duct that stretches out at least in the transverse direction of the web, wherein the suction duct and the blowing duct are separated from one another by a common wall.

7. The drier installation according to claim 6, wherein said common wall is equipped with devices configured to advance thermal exchanges between the sucked combustion products and the blown combustion products.

8. The drier installation according to claim 1, wherein said transversal convective system has a first exterior casing for suction of said combustion products, wherein said first exterior casing has in a longitudinal cross-section according to a plane perpendicular to said web and stretching out according to a median longitudinal axis of said web a substantially U-shaped cross-section with an opening towards the web, wherein said U-shaped first exterior casing substantially stretches out in the transverse direction of the web, wherein said transversal convective system has a second internal casing inside the first external casing for blowing said combustion products, wherein said second internal casing has a wall with a substantially U-shaped longitudinal cross-section with an opening towards the web, wherein said second internal casing stretches out in the transverse direction of the web inside said first external casing.

9. The drier installation according to claim 8, wherein the U-shaped wall of the second internal casing has several first openings, wherein a device to blow air under pressure is arranged substantially in an axis of each first opening so as to create a venturi effect, so as to suck at least a part of the combustion products and to blow them towards the web.

10. The drier installation according to claim 9, wherein the U-shaped wall of the second internal casing has several second openings stretching out in the transverse direction of the web, wherein a cylindrical rotor with radial blades rotating around an axis parallel to the web, said axis being substantially perpendicular to a passing direction of the web, is installed on an interior side of the first external casing in front of each of the second openings.

11. The drier installation according to claim 10, wherein the first or second openings are made in a tube formed by a wall of the transversal convective system that is substantially parallel to the web.

12. The drier installation according to claim 1, wherein said convective system at least has one turbine, an axis of which is substantially perpendicular to the web.

13. The drier installation according to claim 12, wherein each turbine has a centrifugal turbine wheel of which a suction opening is connected to an upstream transversal suction duct in relation to the web, wherein sucked combustion products are blown through two tangential outlet openings substantially directly opposite in the transverse direction of the web and connected to the transverse blowing duct adjacent to the suction duct.

14. The drier installation according to claim 12, wherein said convective system has at least two turbines arranged in a row stretching out in the transverse direction of the web, wherein each turbine cooperates with a corresponding suction and blowing duct stretching out transversally along a respective part of the width of the web.

15. The drier installation according to claim 1, wherein said installation comprises at least two transversal convective systems arranged one after the other in a passing direction of the web and separated one from the other by at least one transversal row of the radiant elements.

16. The drier installation according to claim 1, wherein the web is paper.

17. The drier installation according to claim 1, wherein the radiant elements are gas-heated.

* * * * *